United States Patent [19]

Sokolsky et al.

[11] 3,955,006

[45] May 4, 1976

[54] METHOD OF PACKAGING FOOD USING A LINER

[75] Inventors: Burton H. Sokolsky, Highland Park; William G. Barber, Deerfield, both of Ill.

[73] Assignee: Burton H. Sokolsky, Highland Park, Ill.

[22] Filed: Nov. 5, 1973

[21] Appl. No.: 413,357

Related U.S. Application Data

[63] Continuation of Ser. No. 158,425, June 30, 1971, abandoned.

[52] U.S. Cl. ..... 426/392; 53/14; 53/27; 53/38; 220/256; 229/43; 426/124; 426/130; 426/396

[51] Int. Cl.[2] ..... B65B 61/22; B65B 51/10; B65B 7/28

[58] Field of Search ..... 426/124, 130, 396, 398, 426/392; 220/256, 258, 355–358, 67; 229/43, 485 B; 53/27, 38, 129, 14

[56] References Cited

UNITED STATES PATENTS

| | | | |
|---|---|---|---|
| 675,357 | 5/1901 | Maconochie | 426/124 X |
| 2,652,148 | 9/1953 | Pfeifer | 426/124 X |
| 2,899,782 | 8/1959 | Haidegger | 53/14 |
| 3,116,153 | 12/1963 | Seiferth et al. | 426/129 |
| 3,230,093 | 1/1966 | Albertus | 426/130 |
| 3,301,464 | 1/1967 | Amberg | 229/43 |
| 3,344,974 | 10/1967 | Bostrom | 229/43 |
| 3,394,861 | 7/1968 | Truax | 229/43 |
| 3,561,668 | 2/1971 | Bergstrom | 229/43 |
| 3,628,689 | 12/1971 | Rogers | 229/43 |
| 3,734,276 | 5/1973 | Bank | 426/383 |

*Primary Examiner*—Frank W. Lutter
*Assistant Examiner*—Steven L. Weinstein
*Attorney, Agent, or Firm*—Norman Lettvin

[57] ABSTRACT

A food package which includes a thin-walled wide-mouthed cup shaped container which has a substantially air impervious liner sealingly, but removably bonded to the rim thereof, and a disc-shaped cover having a lip about periphery thereof which matingly engages the container's rim for closing the container.

A process for manufacturing a food package which includes overlying the rim of the container with a liner disc having a pressure-sensitive adhesive coated to one side and pressing the cover downwardly into the container and into engagement with the disc-shaped liner so that the pressure-sensitive adheres to the rim and the cover-lip engages the rim.

1 Claim, 4 Drawing Figures

FIG. 1
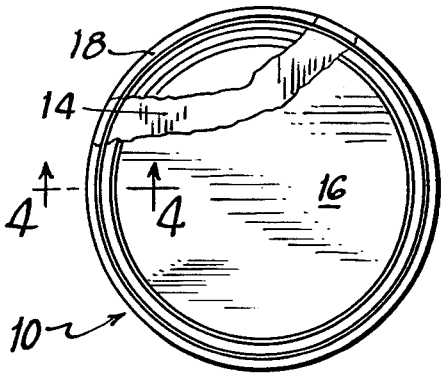
FIG. 3
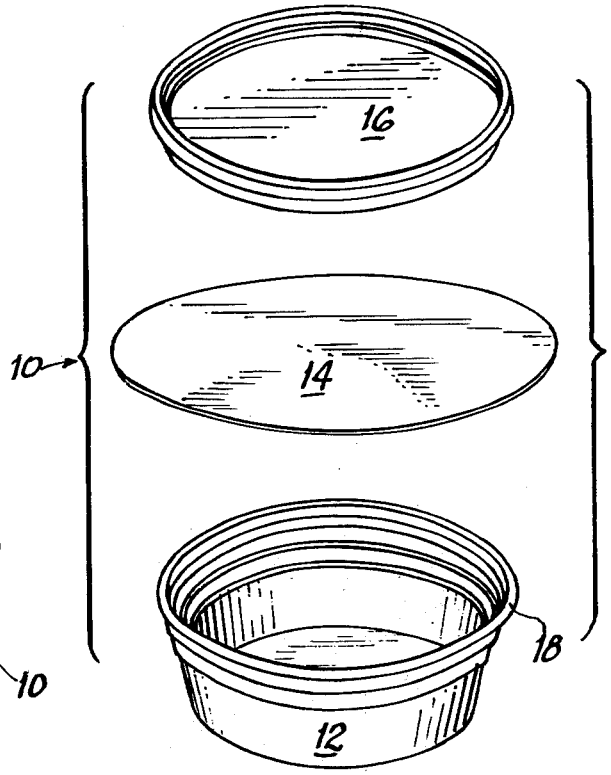
FIG. 2
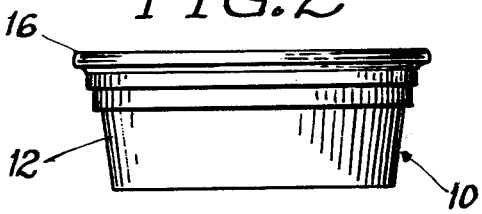
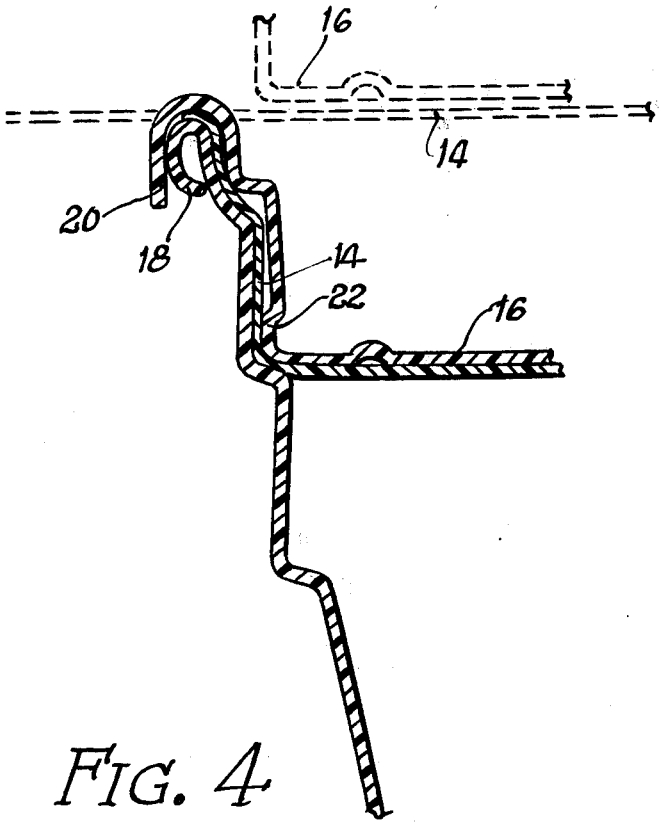
FIG. 4
INVENTORS
Burton H. Sokolsky
William G. Barber
by Lettvin and Gerstman
Attys

METHOD OF PACKAGING FOOD USING A LINER

This is a continuation of application Ser. No. 158,425, filed June 30, 1971, now abandoned.

BACKGROUND OF THE INVENTION

This invention relates to containers; and in particular to food packages having an air impervious liner across the mouth thereof.

Semi-solid food products such as sour cream, whipped butter, cheeses, and various other types of food products are packaged in cupshaped, open mouth, thin-walled containers. A cover having a lip-type rolled edge which engages the rolled rim is used to cover the package. Normally, both the container member and cover are thin-walled (about 0.10 inches thick) and made of a material, such as polystyrene. In the automatic process of producing the packaged food, it was found that in order to close the package the cover must be provided with air vents so as to permit the air entrapped between the food and cover to escape when the cover is pressed onto the container. However it has been found that the venting feature also permits the inflow of air into the package. This inflow of air can provide oxygen for the oxidation or fermentation of the food product.

Various attempts have been made to reduce this possibility of spoilage. One such attempt has included the application of a parchment liner directly onto the top surface of the food product in order to limit to as great extent as possible contact of air with the normally exposed surface of the food; however, the parchment itself is porous, and although to some extent it is effective, nevertheless it is not wholly effective. Another attempt has involved providing a package that includes a container and a cover that carries a heat-sealable plastic liner. In the latter package the cover is preassembled with a disc of heat-sealable material adhered to the inner or underside of the cover. This is normally done by applying gobs of hot wax to the inner side of the cover and then overlying the cover and wax with a disc of heat-sealable material. This subassembly (cover and liner) is then mounted to the filled container in the standard manner, but then, in order to completely seal the package the cover and rim of the package are heated so as to cause the plastic liner to adhere to the rim. Although this process is effective to effect a complete seal, the package and its process has a number of disadvantages including the steps of pre-assembly and the heating of the cover to produce the hermetic seal. This heating is communicated through the cover to the food product and this is undesirable particularly when the product is intended to be maintained chilled at all times.

Thus, an object of this invention is to provide an improved package which avoids the problems hereinabove noted, and which characterized by effectiveness without substantial increase in cost. In general the package requires that the liner reduce the amount of air entering the package to a low level; that the liner be substantially inert to automated procedures normally used with thin-walled packages; and that the process by which the liner is applied have no adverse effects on the food product.

SUMMARY OF THE INVENTION

It has been found that a food package which overcomes the previously described disadvantages can be prepared by utilizing a liner disc which consists of a substantially air-impervious substance having one side coated with a normally substantially non-tacky but pressure-sensitive adhesive which is substantially inert with respect to the food product. The package thus consists of a thin-walled container having a thin-walled cover and a sheet of substantially air-impervious plastic coated with an adhesive disposed across the mouth of the container and adhering to the rim thereof. The process for manufacturing the containers described herein is suitable for inclusion in mass-production lines; since in principle all that is required is that after the container has been filled with the food product, that the liner with the adhesive side facing toward the food product be placed in position to overlie the food product and the rolled rim. The cover is brought into position and pressed onto the rim in the normal fashion which thereby closes the container and causes the adhesive to first grip the container and as pressure is applied, the adhesive is scrubbed onto the inner wall of the container adjacent the lip, so that under pressure the liner becomes bonded to the rim, thereby completely closing the package without use of heat and permitting ready removal of the lid for examination of the seal, without disturbing the seal of the product in the container.

BRIEF DESCRIPTION OF THE DRAWINGS

FIG. 1 is a plan view of a partially broken away package made in accordance with this invention;

FIG. 2 is an elevational view of a package made in accordance with this invention;

FIG. 3 is an exploded perspective of view showing the principal elements of the package; and FIG. 4 is a greatly enlarged sectional view taken along line 4—4 and in the direction shown in FIG. 1, depicting the engagement of the container rim, liner and cover.

DESCRIPTION OF THE PREFERRED EMBODIMENT

Referring first to FIGS. 1, 2 and 3 the package assembly is shown as 10, generally. This assembly includes the container 12, the liner 14 and the cover 16. As is seen in FIG. 1, the container 12 is a relatively wide-mouthed container of the type commonly used for packaging semi-solid products such as sour cream, cottage cheese, whipped butter and the like. Since the package does not require great strength, it is normally made of a thin-walled material such as polystyrene, paper or even sheet metal. The thickness of the packaging materials is on the order of 0.010 inches but may range between 0.005 and 0.020 inches.

All of the containers are provided with a rolled edge or bead 18 about the peripheral edge of the mouth of the container. This rolled edge is provided for safety reasons and to assist in sealing the cover to the container as described hereinafter. The cover 16 is also a thin-walled material and has a lip 20 about its peripheral edge. The lip 20 is a shaped edge formed into the shape of an open channel and which extends continuously about the periphery of the cover 16. The dimensions of the lip 20 and the rolled edge 18 are such that the lip and rolled edge sealingly engage each other. The covers of the prior art had a plurality of venting holes therein for permitting the air entrapped in the package during the packaging process to escape. These venting apertures need not be present in the package of this invention.

In the package herein, the liner 14 provides the desired seal over the food. The liner is a thin plastic material which is substantially air impervious, flexible but shape sustaining, and can be coated with a pressure-sensitive adhesive. The thickness of the liner 14 is limited only by its forming characteristics. It should not be so thick as to present problems in deforming to conform to the space between the rolled edge 18 and the lip 20; on the other hand it should be sufficiently thick to be shaped sustaining so as to assure its handling characteristics which permit it to be disposed across the mouth of the container. The shape-sustaining characteristic is also important when using automated equipment for handling the liner. Normally, the thickness of the liner 14 is substantially less than the container wall and is made of cellophane. One side is coated with a pressure-sensitive adhesive. The characteristics of the adhesive are that it be substantially nonreactive with the food and that upon the application of sufficient pressure to close the package that the adhesive hold the liner 14 to the rim 18. Starch powder can be "dusted" or applied in a thin coating over the adhesive coating so as to prevent premature adhesion and to present a compatible surface to the food product.

Pressure-sensitive adhesives are well known in the art and any adhesive that can be coated to the cellophane liner and is nonreactive with the food may be used. Reference should be made to the Kirk-Othmer Encyclopedia of Chemical Technology, second edition, published by Interscience Publishers, a division of John Wiley and Sons, Inc., New York and London at pages 371 to 405 wherein adhesives in general are discussed; more particularly pressure-sensitive adhesives are discussed at page 382. Milprint Inc. International of Milwaukee, Wisconsin can provide a liner meeting the above-described requirements made from a material identified by their trade-name "Kling-Seal".

As seen in FIG. 4, in the completed package the liner 14 is formed between the rolled edge 18 and lip 20. Since the coated side of the liner faces toward the food or interior of the package, the liner is bonded in the area of contact between the rolled edge 18 and the liner 14. The cover 16 is provided with a radially projecting rim 22 about its lower periphery; as the cover is fitted to the container the radially projecting edge 22 acts as a "scrubber" to ensure contact and adherence between the liner 14 and the upper portions of the container 12.

A completed package as described hereinabove provides the advantage that once the package is sealed, little, if any air can enter the package and thus oxidation or fermentation of the product is effectively precluded; furthermore, by using a pressure-sensitive adhesive no heat has been applied to the package and thus another possible cause of spoilage is eliminated.

Turning now to the process by which the package is made, and FIG. 4, it will be understood that the container 12 is filled with food product in the normal manner. The disc-shaped liner 14 is then laid over the mouth of the container 12 as shown in phantom. The positioning of the liner over the container may be done by hand but more preferably it is done by machinery which utilizes a vacuum lifting apparatus. It is appreciated that in order to provide a truly automated process the liner 14 must be shape sustaining so that it may be accurately disposed over the container 12 while not being so rigid as to prevent proper formation of the seal and accommodation to the edge and lip. Furthermore, the liner 14 must be substantially air impervious so that the vacuum apparatus is capable of holding and positioning it. One problem that might occur if the liner 14 were not shape sustaining is that in placing the liner over the container it may be so limp that its edges would fold over or be caught within the container and therefore not engage the entire rim 18.

Once the liner 14 is disposed across the opening of the container the cover 16 is pressed into engagement with the container and rim 18. This may be done by means of the standardly available packaging machinery. As the cover 16 moves downwardly the outer edges of the liner 14 are pressed into engagement with the rim 18 and a shearing or scrubbing action takes place between the rim 18 and the lip 20 as well as along the container where it is engaged by the scrubber or radial edge 22. This action provides the necessary forces to activate the pressure-sensitive adhesive to adhere the liner 14 to the rim 18.

It will be appreciated that numerous modifications and changes can be made to the embodiment disclosed herein without departing from the spirit and scope of this invention.

What we claim and desire to secure by Letters Patent of the United States is:

1. In a process for automatically packaging and covering, without use of heat, a chilled food product that partially fills the interior of a container, leaving the upper inner sidewall and uppermost rim portion of the container exposed to receive cover means thereonto, the improvement comprising the steps of: placing a sheet of flexible, but shape-sustaining material, having its support side coated with a pressure-sensitive adhesive, in overlying relation onto the uppermost rim portion of a container that is partially filled with a chilled food product, and then pressing a pre-formed outer cover member into the container and onto the uppermost rim portion of the container to force air from the container and to grippingly secure the outer cover to the rim portion of the container by a press fit while simultaneously flexing the sheet inwardly into the partially-filled container to pressure activate said pressure-sensitive adhesive and to pressure scrub a portion of said adhesive, as the sheet is flexed into the container, against both the uppermost rim portion and adjacent inner sidewall portions of the container, to effect a substantially continuous air-impervious adherent seal between the sheet and the portions of the container engaged by the sheet.

* * * * *